US005615979A

United States Patent [19]

Lin

[11] Patent Number: 5,615,979

[45] Date of Patent: Apr. 1, 1997

[54] MINE SUPPORT BAG

[76] Inventor: Fen-Fen Lin, 33 Champagne Street, Bayswater, Bloemfontein, South Africa

[21] Appl. No.: 520,243

[22] Filed: Aug. 28, 1995

[30] Foreign Application Priority Data

Aug. 14, 1995 [ZA] South Africa ..... 95/6762

[51] Int. Cl.[6] ..... E02D 15/32; E02D 7/00

[52] U.S. Cl. ..... 405/289; 405/288; 405/303

[58] Field of Search ..... 405/288, 289, 405/258; 156/200, 202, 544; 5/451

[56] References Cited

U.S. PATENT DOCUMENTS

| | | | |
|---|---|---|---|
| 2,990,166 | 6/1961 | Walsh | 405/289 X |
| 3,508,408 | 4/1970 | LeJeune | 405/289 |
| 3,528,876 | 9/1970 | Von Clave-Bouhaben et al. | 156/200 X |
| 3,752,723 | 8/1973 | Bruneau | 156/202 X |
| 4,058,425 | 11/1977 | Thrun | 156/200 |
| 4,073,021 | 2/1978 | Carlisle | 5/451 X |
| 4,092,750 | 6/1978 | Ellis | 5/451 X |
| 5,405,471 | 4/1995 | LeMaster | 156/202 |

*Primary Examiner*—Dennis L. Taylor

*Attorney, Agent, or Firm*—Walter H. Dreger; David R. Heckadon

[57] ABSTRACT

A mine support bag comprises an inner fabric tube of selected length and selected circumference having an inner surface and outer surface. A first fabric sheet is laminated to the outer surface on the one side of the tube, the first fabric sheet having a width which is wider than half of the tube circumference. The first fabric sheet has longitudinal edges which run generally parallel with the length of the tube and extend beyond opposite lateral edges of the tube. A second fabric sheet is laminated to the opposite side of the tube, the second fabric sheet having a width which is wider than half of the tube circumference, the second fabric sheet having longitudinal edges which run generally parallel with the length of the tube and extend beyond opposite lateral edges of the tube. The respective lateral edges of the first and second sheets overlie each other and are laminated together. The opposite ends of the tube are sealed to thereby form a sealed bag the sealed bag has a valve therein through which a pressurising fluid can be introduced into the interior of said bag. The invention extends to a method of forming a mine support bag.

8 Claims, 4 Drawing Sheets

MINE SUPPORT BAG

BACKGROUND TO THE INVENTION

This invention relates to a mine support or pre-stressing bag of the type which is adapted to be placed between the hanging wall and the top of a support pack or timber pack and then filled with a settable grout under pressure to place a pre-stress on the pack.

The aforementioned type of support bag is known and is used reasonably extensively in the mining industry. The advantage of using a support bag is that the hanging wall is supported immediately by the pack so that no settling of the hanging wall is necessary in order for the pack to take up its load. This reduces fracturing of the hanging wall and hence maintains the integrity of the hanging wall thereby reducing the chances of rock falls and like hanging wall failures.

Prior art support bags have generally comprised two types of bag, namely weeping bags which are designed to allow liquid pumped into the bag to weep as the grout within the bag sets and, non-weeping bags which are basically liquid impervious. This invention is concerned with non-weeping type bags. Non-weeping bags have in the past suffered from various disadvantages. These generally concern leakage which can arise from various causes, such as abrasion of the bag, or failure at a join in the bag. Leakage frequently occurs at points where the fabric sheet from which the bags are made is joined, particularly where the joins are stitched together. In extreme cases leakage can result in the failure of the bag which can, in turn, lead to a catastrophic failure of the support.

One prior art bag which has proved reasonably successful in practice comprises an inner impervious bag and one or more outer high strength bags. The impervious bag is protected against external abrasion by the outer bags and the outer bags tend to protect the inner bag against rupture by constraining the inner bag. This allows the inner bag to withstand high internal pressures.

This type of mine support bag is, however, reasonably expensive to produce. Also, failures can occur, particularly where the inner bag is crimped or folded for some reason or where the inner bag is imperfectly restrained. Assembly of such composite bags has also been found to be both time consuming and labour intensive.

SUMMARY OF THE INVENTION

According to the invention there is provided a mine support bag comprising, an inner fabric tube of selected length and selected circumference having an inner surface and outer surface, a first fabric sheet laminated to the outer surface on the one side of the tube, said first fabric sheet having a width which is wider than half of said circumference, said first fabric sheet having longitudinal edges which run generally parallel with the length of said tube and extend beyond opposite lateral edges of said tube, a second fabric sheet laminated to the opposite side of said tube, said second fabric sheet having a width which is wider than half of said circumference, said second fabric sheet having longitudinal edges which run generally parallel with the length of the tube and extend beyond opposite lateral edges of said tube, the respective lateral edges of the first and second sheets overlying each other and being laminated together, the opposite ends of the tube each being sealed to thereby form a sealed bag; said sealed bag having a valve therein through which a pressurising fluid can be introduced into the interior of said bag.

Said ends of the tube are preferably folded over at least once to form said sealed end. In a preferred form of the invention the said ends of the tube are folded over a plurality of times and each fold has an adhesive applied thereto across the width of the bag to thereby strengthen the seal. Optionally one or more straps can be adhered over and around each of said sealed ends to increase the strength thereof. In addition, each end may have a rigid strip which lies transversely to the length of the tube and is located between folds in each end to enhance the strength of the seal in each end.

The bag may include a reinforcing band or strap which extends around the bag at or adjacent said valve to thereby strengthen the bag in the region of the valve.

The bag may be made from any suitable fabric material such as a woven polypropylene fabric. The material used to laminate the different components together may comprise polyethylene or the like which will provide a non-pervious layer when bonded between two sheets of fabric material.

The invention extends to a method of forming a mine support bag comprising the steps of:

providing a fabric tube of selected length and selected circumference having an inner surface and an outer surface;

laminating a first fabric sheet to the outer surface on one side of the tube, said first fabric sheet having a width which is wider than half of said circumference, said first fabric sheet having longitudinal edges which run generally parallel to the length of the tube and extend beyond opposite lateral edges of said tube;

laminating a second fabric sheet to the opposite side of said tube, said second fabric sheet having a width which is wider than half of said circumference, said second fabric sheet having longitudinal edges which run generally parallel to the length of the tube and extend beyond opposite lateral edges of said tube, said longitudinal edges of said second fabric sheet being simultaneously laminated to the longitudinal edges of the first fabric sheet;

sealing the opposite ends of the tube to form a sealed bag; and fitting a valve to the sealed bag through which a pressurising fluid can be introduced into the interior of the bag in use.

Said step of sealing the ends of the tube may include the step of folding each respective end of the tube over at least once and preferably a plurality of times. The method may furthermore include the step of securing one or more straps around said ends to increase the strength of the ends.

These and further features of the invention will be made apparent from the description of a preferred embodiment thereof given below by way of example. In the description reference is made to the accompanying drawings but the specific features shown in the drawings should not be construed as limiting on the invention.

DETAILED DESCRIPTION

Figure 1:
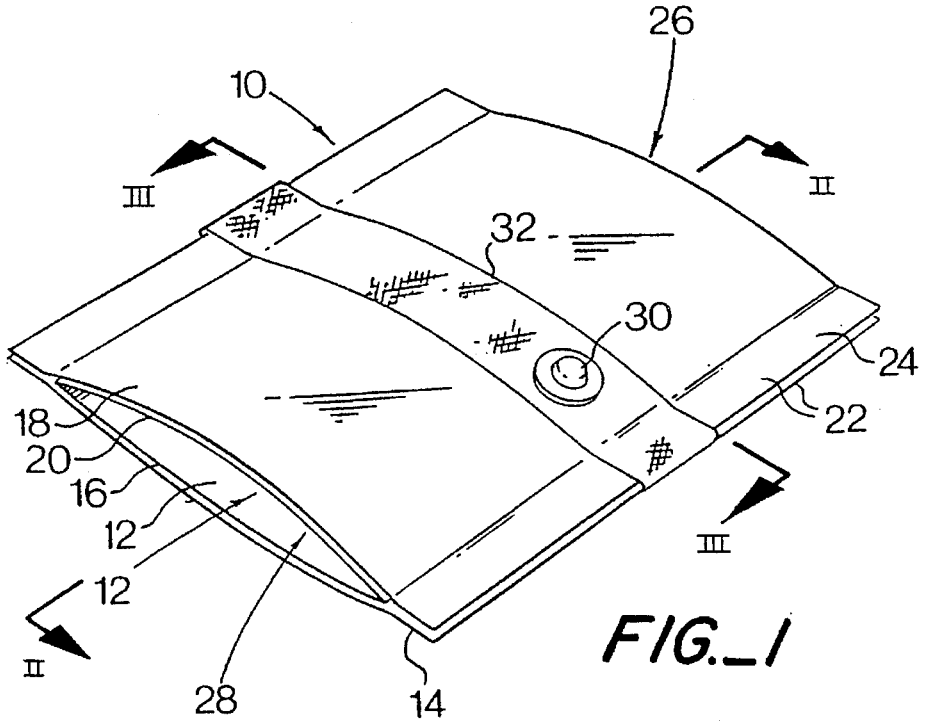
FIG. 1 shows a perspective view of a mine support bag according to the invention in a partially completed condition.
Figure 2:
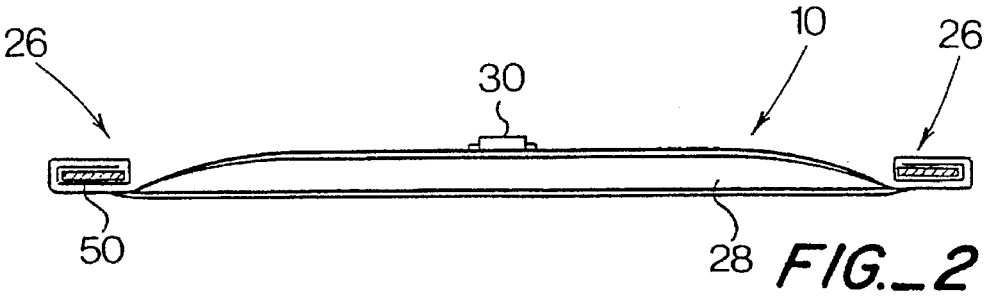
FIG. 2 shows a cross-sectional view along line II—II depicted in FIG. 1 of the drawings, but with the bag in a completed condition.
Figure 3A:
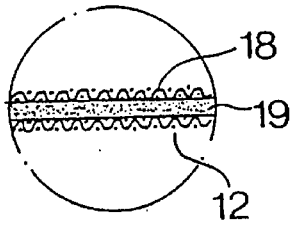
FIG. 3 shows a cross-sectional view along lines III—III depicted in FIG. 1 of the drawings.
Figure 3:
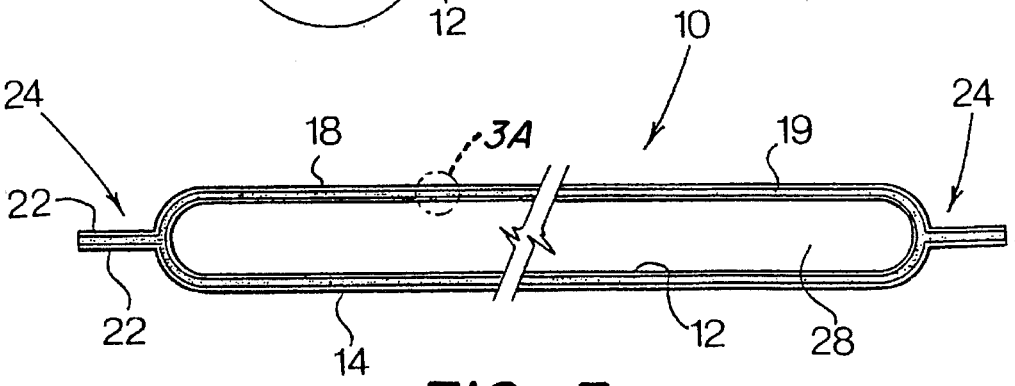
Figure 4:
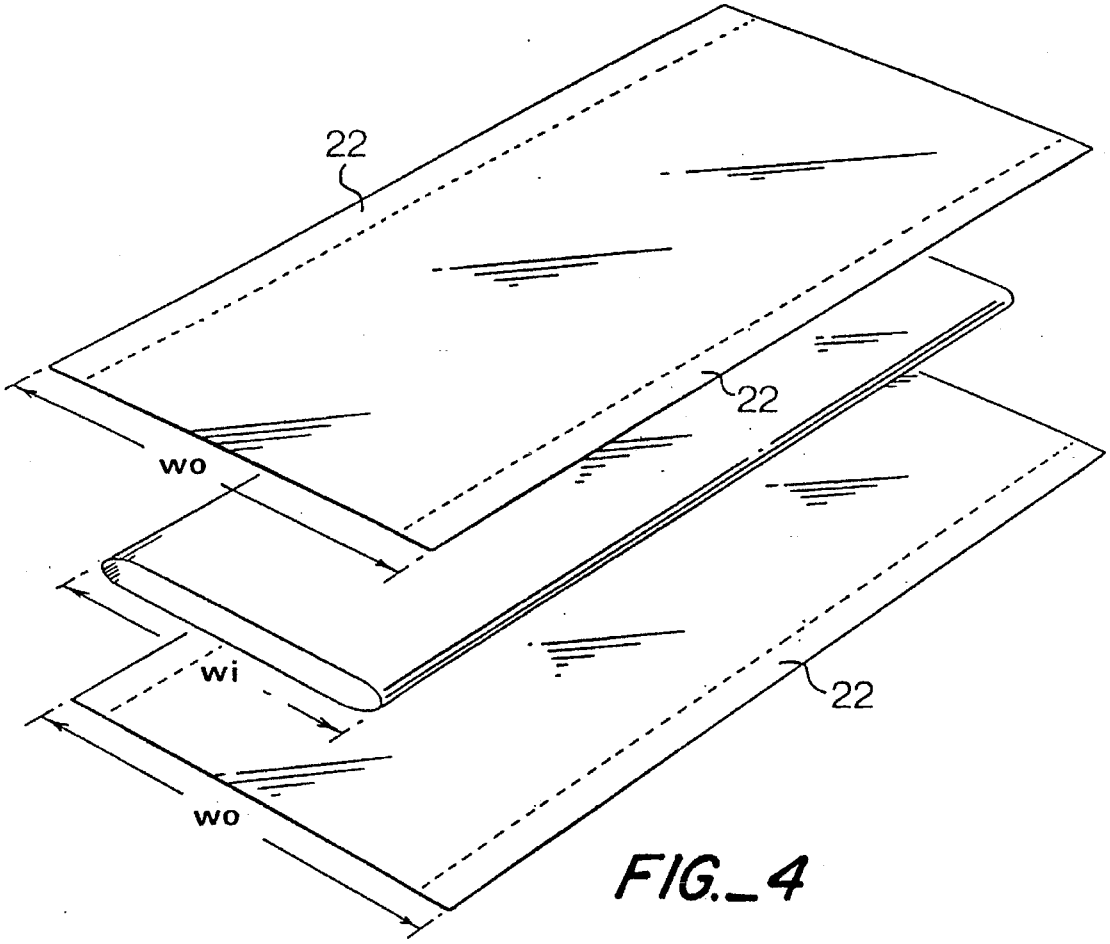
FIG. 4 shows a perspective exploded view of the three main components which are used to make up a mine support bag according to the invention.

As shown in FIGS. 1 to 4 of the drawings a mine support bag 10 comprises an inner fabric tube or sleeve 12 which preferably comprises a woven material which is woven in a tubular form so that the tube is seamless along its length. A seamless tube will be significantly stronger than a tube which is formed having a continuous seam running along its length. A welded or glued seam tends to rupture in use whereas a stitched seam will tend to induce leakage in the bag. It is thus considered an important aspect of the invention that the tube 12 is seamless. The tube 12 as shown in the drawings is shown as being substantially flat. Of course, in use, the tube will be filled with grout or other suitable material which will swell the tube outwardly.

The tube 12 has a first fabric sheet 14 laminated to one side thereof, numbered 16, and a second fabric sheet 18 laminated to the opposite side 20 thereof. The sheets 14 and 18 have a width, indicated in FIG. 4 as being "wo" whereas the tube 12 in its flat condition has a width indicated in FIG. 4 as being "wi". Thus, when the first sheet 14 and the second sheet 18 are bonded to opposite sides of the tube 12, the longitudinal edges 22 of the two sheets extend beyond the opposite side edges of the tube to form overlapping edge strips 24 which run along each side of the tube 12. The edges 22 are thus in face to face contact with each other and are laminated together with the effect that the entire circumference of the tube 12 is effectively sealed along the full length of the tube 12 except for the ends 26 thereof. The ends 26 are sealed in a second operation which is described in detail herebelow.

Access to the interior 28 of the bag is provided through a valve 30 located in one major side face of the bag, the valve 30 comprising a suitable one way valve adapted to permit the introduction of a fluid under pressure into the interior 28 of the bag but which will retain that pressure within the bag after the nozzle used for introducing the fluid has been removed from the valve 30. Since providing the valve 30 in the bag will provide a weak point for the bag it is preferred that a reinforcing band or strap 32 is fitted around the circumference of the bag in the region of the valve 30.

Figure 5:
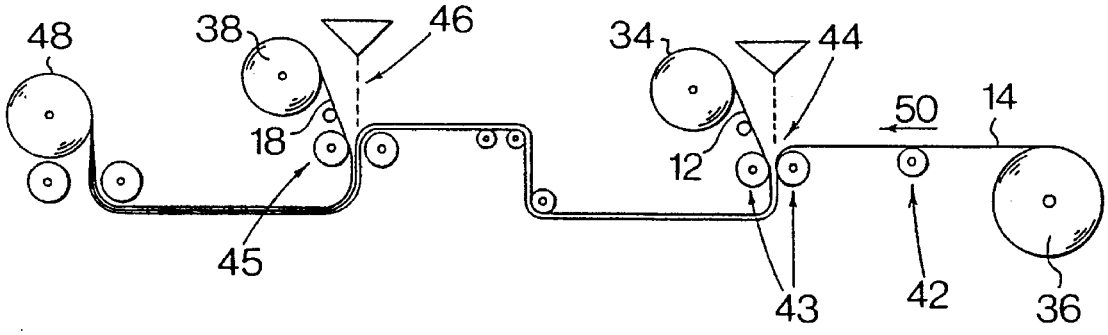
FIG. 5 shows a diagrammatic side view of apparatus used in the method of forming bags according to the invention.

It is preferred that a continuous process is used to form the laminated tube depicted in FIG. 1 of the drawings. A typical process is described with reference to FIG. 5 of the drawings. It is envisaged that the tube material 12 will be provided in a roll indicated at numeral 34, the first sheet material 14 will be provided in a roll indicated at numeral 36 and a second sheet material 18 will be provided in a roll indicated at numeral 38. The first sheet material 14 will run in the direction of arrow 50 past a roller 42 and from there will be laminated to the underside of the tubular material 12 by a lamination station 44. The lamination station 44 will laminate to the underside of the tube 12 and the edges of the sheet 14. Lamination rollers 43 will urge the tube 12 and sheet 14 together. From there the laminated sheet will run to a second lamination station 46 which will apply adhesive to the upper side of the tube 12 as well as the edges 22 of the upper sheet 18. From there the composite sheet will pass between a second set of lamination rollers 45 which serve to laminate the sheet 18 to the upper side of the tube 12 and will also serve to laminate the edges 22 of the sheets 14 and 18 together. Clearly, depending on the material from which the sheets 14 and 18 and the tube 12 are formed as well as the material used for the lamination, the process may need to undergo additional steps such as heating for example. It will, however, be appreciated that the process of forming the tube depicted in FIG. 1 can be conducted as a continuous process. After the lamination has been completed the length of tubular material will be cut to the desired lengths and the ends 26 of the laminated tube will be sealed as described in detail herebelow.

Figure 6:
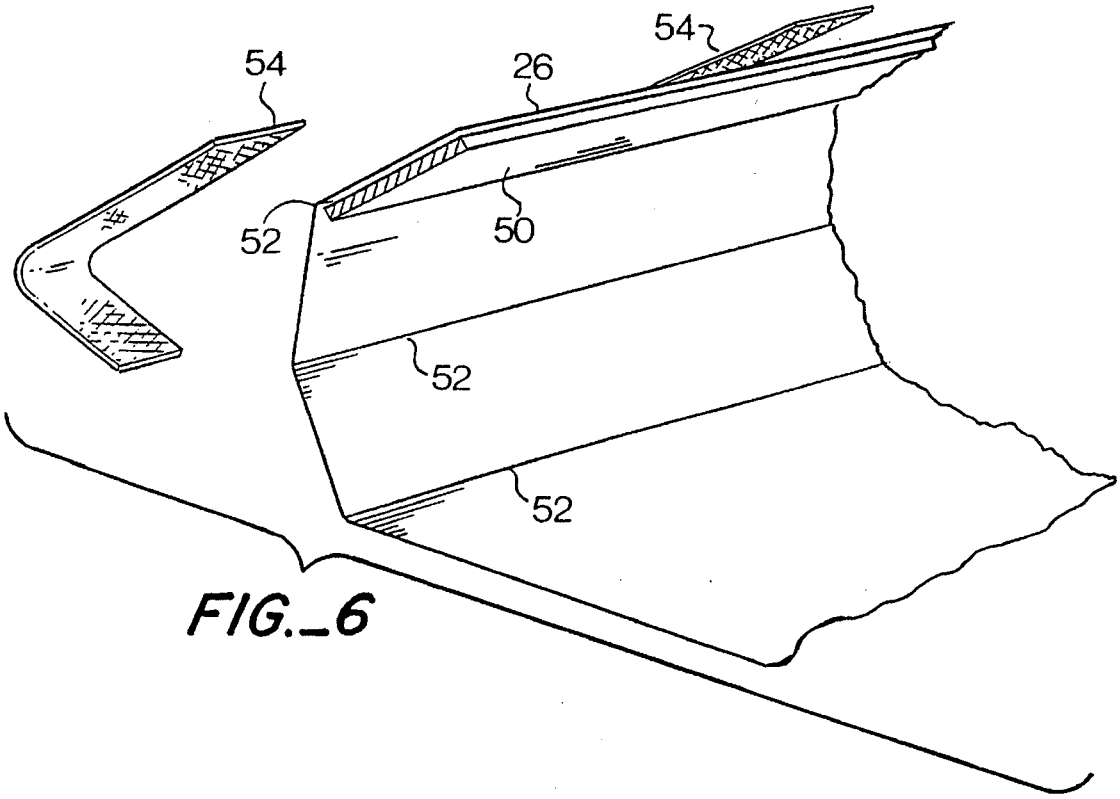
FIG. 6 shows a perspective view of one end of a bag according to the invention in a partially folded condition.
Figure 7:
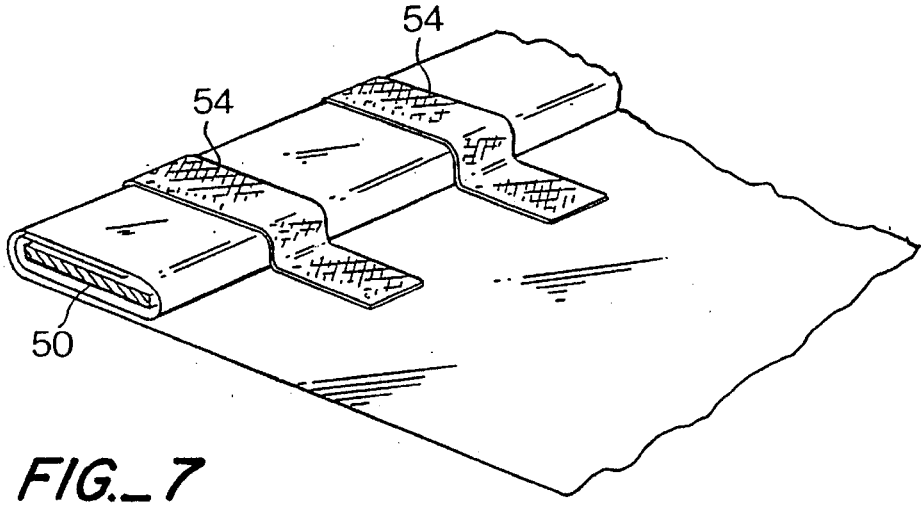
FIG. 7 shows a similar view to that of FIG. 6 with the end of the bag in a fully folded and sealed condition.

Turning now to FIG. 6 of the drawings, the sealing of an end 26 of a bag is depicted somewhat diagrammatically. The end 26 will preferably have a relatively rigid strip 50 bonded to one face thereof, the strip lying transverse to the length of the tube and having a length approximately equal to "wi". The end will then be folded over along the fold lines indicated at 52. After each fold 52 is made an adhesive will be applied into the region where the next fold will take place so that each face of the fold is adhered to the other. Thereafter reinforcing straps or bands 54 may be adhered around the entire folded end as depicted in FIG. 7 of the drawings to complete the sealing of the end of the bag. The straps 54 will serve to resist the tendency of the end to unfold as the pressure within the bag increases. Tests have shown that this type of sealing of the end of the bag works to effectively seal the bags at the desired pressures thereof. The strip 50 tends to keep the edges of the fold apart and thereby increases the sealing effect at the edges of the folds.

Figure 8:
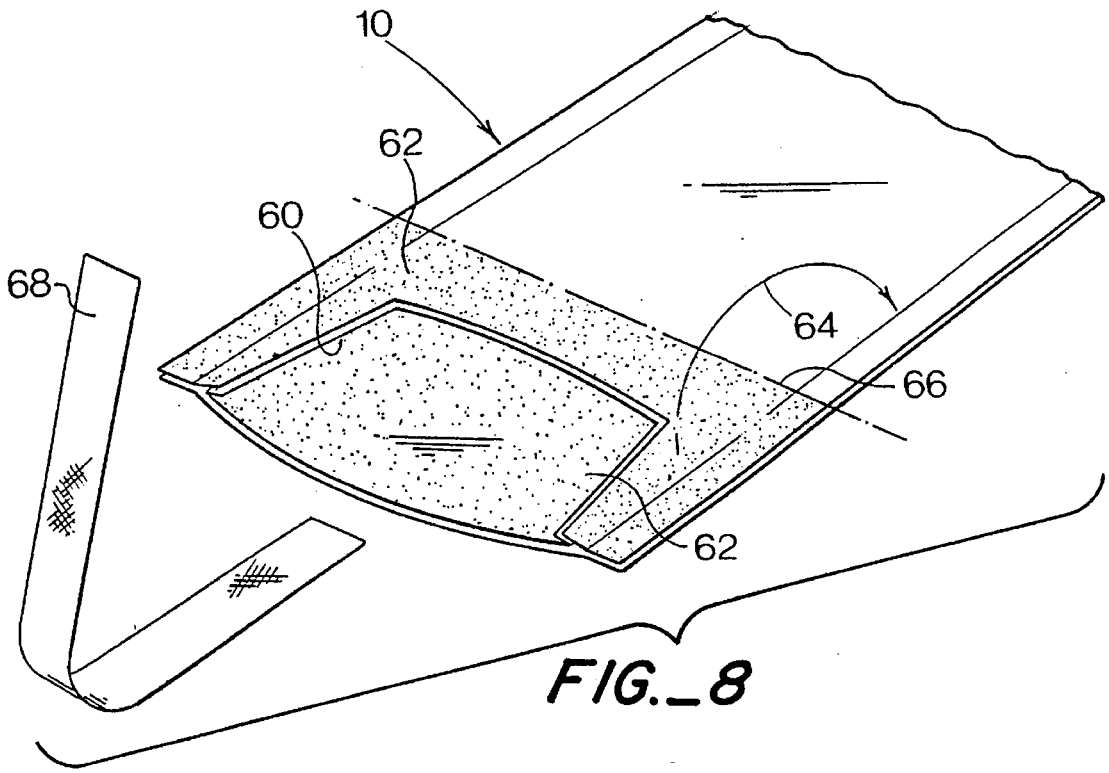
FIGS. 8 & 9 depict an alternative end seal arrangement.
Figure 9:
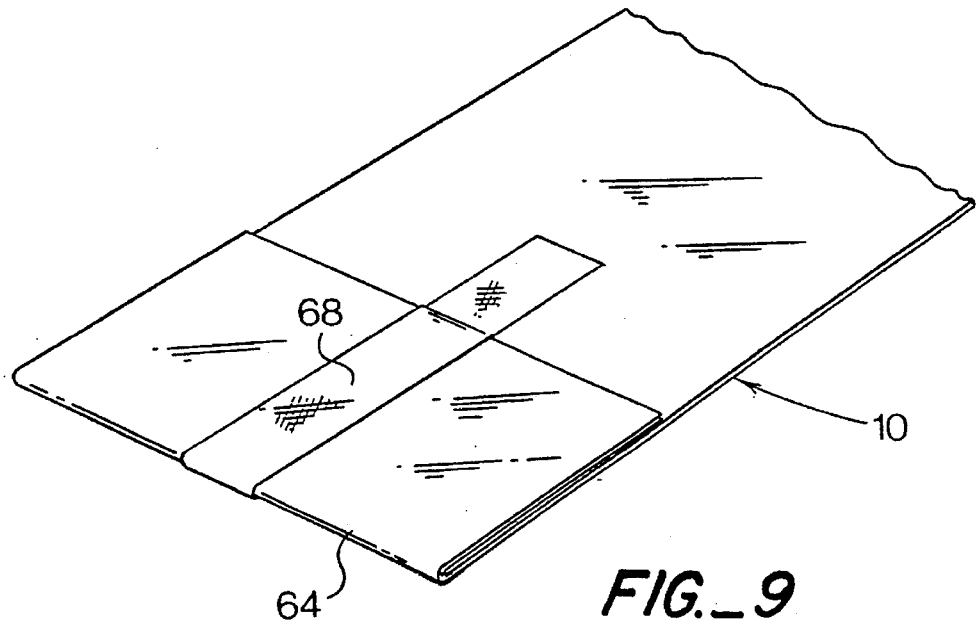

FIGS. 8 and 9 of the drawings depict an alternative manner of sealing the ends of the bag. As shown, the upper side of the bag is cut away as indicated at numeral 60. A glue coating is then applied to the end region of the bag as indicated in numeral 62. The bag is then folded in the direction of arrow 64 along fold line 66. This will adhere one face of the fold to the other to form a sealed seam. A cut-out 60 enhance the quality of the seal and limits the extent to which the seal would be likely to rupture. A strap 68 may be used, as shown, to strengthen the sealed end.

Clearly the method of sealing the end as shown in FIGS. 8 and 9 is far simpler to that shown in FIGS. 6 and 7 and therefore may prove to be the preferred sealing arrangement, at least for some applications.

Any suitable material may be used to form the bag shown in the drawings although it is preferred that woven polypropylene fabric is used. A polyethylene material can be used for lamination which will seal a fabric as well as laminating the fabric sheets together.

It should be noted that the mine support bag described herein has a number of advantages over prior art bags of this type. In particular, since no separate bladder or impervious bag is inserted into the interior of the high strength bag this labour intensive operation is avoided. In addition, it will be appreciated that the laminating material effectively forms an impervious bag or bladder around the inner tube and within the envelope defined by the two outer sheets. This impervious bag is, however, protected against abrasion and damage both from material within the bag and from abrasion or damage from the outside of the bag. Since the impervious bag is not a separate component there is no possibility of it crimping or dislodging and therefor the problem previously referred to of the inner bag failing will be avoided.

Although tests have shown that the method of sealing the ends of the bag operates effectively in practice other methods of forming the sealed end are also envisaged. For example, it may be simpler to form a sealed end with a single fold provided that adhesive is applied to the interior of the tube adjacent the ends prior to that fold being made. It may also be found that the straps 54 and/or the rigid strip 50 are essential to form an effective seal.

I claim:

1. A mine support bag comprising an inner fabric tube of selected length and selected circumference having an inner surface and outer surface, a first fabric sheet laminated to the outer surface on the one side of the tube, said first fabric sheet having a width which is wider than half of said circumference, said first fabric sheet having longitudinal edges which run generally parallel with the length of said tube and extend beyond opposite lateral edges of said tube, a second fabric sheet laminated to the opposite side of said tube, said second fabric sheet having a width which is wider than half of said circumference, said second fabric sheet having longitudinal edges which run generally parallel with the length of the tube and extend beyond opposite lateral edges of said tube, the respective lateral edges of the first and second sheets overlying each other and being laminated together, the opposite ends of the tube each being sealed to thereby form a sealed bag; said sealed bag having a valve therein through which a pressurising fluid can be introduced into the interior of said bag.

2. A mine support bag according to claim 1 wherein the ends of the tube are folded over at least once to form said sealed ends.

3. A mine support bag according to claim 2 wherein the ends of the bag are folded over a plurality of times and each fold has adhesive applied thereto across the width of the bag to thereby strengthen the seal and thereby increase the resistance to rupture of the sealed ends.

4. A mine support bag according to claim 2 wherein one or more straps are adhered around and over each of said sealed ends to increase the strength thereof.

5. A mine support bag according to claim 2 wherein each end has a rigid strip incorporated into said fold or folds which lies transversely of the length of the tube.

6. A mine support bag according to claim 1 wherein the bag includes a reinforcing band or strap around the bag at or adapted to the valve to strengthen the bag in the region of the valve.

7. A mine support bag according to claim 1 wherein the bag and first and second sheets comprise polypropylene fabric.

8. A mine support bag according to claim 1 wherein the material used to laminate the sheets to the tube comprises polyethylene.

* * * * *